US006178192B1

(12) United States Patent
Chisaki

(10) Patent No.: US 6,178,192 B1
(45) Date of Patent: Jan. 23, 2001

(54) RAW MATERIAL HEATING APPARATUS

(75) Inventor: Tatsu Chisaki, Saitama (JP)

(73) Assignee: Chisaki Co., Ltd., Tokyo (JP)

( * ) Notice: Under 35 U.S.C. 154(b), the term of this patent shall be extended for 0 days.

(21) Appl. No.: 09/536,414

(22) Filed: Mar. 28, 2000

(30) Foreign Application Priority Data

Apr. 16, 1999 (JP) ..... 11-109014

(51) Int. Cl.[7] ..... F27D 3/00

(52) U.S. Cl. ..... 373/79; 373/20; 373/33; 373/80

(58) Field of Search ..... 373/71–73, 77, 373/79, 81, 83, 85, 86, 109, 110, 111, 115, 20, 27, 33; 266/45, 46

(56) References Cited

U.S. PATENT DOCUMENTS 1,282,445 * 10/1918 McKee ..... 373/79
3,569,987 * 3/1971 Yonemochi ..... 373/115
3,622,141 * 11/1971 Brusa ..... 373/79
3,690,867 * 9/1972 Sibakin et al. ..... 373/79

* cited by examiner

*Primary Examiner*—Tu Ba Hoang
(74) *Attorney, Agent, or Firm*—Kanesaka & Takeuchi

(57) ABSTRACT

A raw-material heating apparatus in which raw-material supplying pipes and exhaust pipes are disposed in a peripheral portion of a furnace cover, a heating space is formed by the furnace cover, a peripheral wall, and a hearth, a raw material which is supplied from the raw-material supplying pipes and deposited on the hearth is heated by a heating gas which flows into the heating space, and pushers are supported by the peripheral wall for pushing out the raw material on the hearth toward a drop port formed in a central portion of the hearth, the deposited raw material on the hearth being caused to drop consecutively through the drop port by the reciprocating motion of the pushers, characterized in that lower-end openings of each raw-material supplying pipe and each exhaust pipe, when viewed in an axial direction of the apparatus, are disposed at a same position or at positions close to each other in an effective region for pushing out the raw material by the pusher.

7 Claims, 6 Drawing Sheets

RAW MATERIAL HEATING APPARATUS

BACKGROUND OF THE INVENTION

1. Field of the Invention

The present invention relates to a raw-material heating apparatus, and more particularly to a vertical-type raw-material heating apparatus for heating a raw material such as a raw ore prior to effecting heat treatment such as maturing.

2. Description of the Related Art

As an apparatus of this type, for example, one shown in the appended drawing FIG. 5 is known. In this known apparatus, a heating section A is formed by an upper portion above a hearth 51, while a vertical-type hollow cylindrical member 53 communicating with a lower portion therebelow by means of a drop port 52 in the hearth 51 is disposed below the heating section A so as to form a maturing section B for maturing and cooling the raw material.

The hearth 51 of the above-described known apparatus rotates about a vertical axis 58A, and rod-like pushers (material pushing-in devices) 54 for allowing a deposited layer of a raw material M formed on a hearth surface 51A to drop gradually through the drop port 52 which is open in the center are provided above the hearth 51.

A heating gas (mainly a combustion gas) is supplied from a heating-gas blowing pipe 58 to a heating space 57 formed in such a manner as to be surrounded by a furnace cover 55, a peripheral wall 56, and the hearth 51. The raw material M in a deposited layer surface M1 on the hearth 51 is directly heated by the heating gas, and its temperature rises. The heated raw material M in the deposited layer surface over the hearth 51 drops into the vertical-type hollow cylindrical member 53 from the drop port 52 by the action of the pushers 54, thereby forming a deposited layer M2 inside the hollow cylindrical member 53.

As also shown in FIG. 6, which is a cross-sectional view taken along VI—VI in FIG. 5, the aforementioned rod-like pushers 54 are provided at a plurality of circumferential positions (incidentally, in FIG. 6, the drop port 52 located below the cross-sectional line VI—VI in FIG. 5 is shown by a two-dot chain line for reference sake). In the case illustrated in FIG. 5, the timings of operation of the plurality of pushers 54 are alternately staggered. Each pusher 54 has an effective region E for effectively feeding the raw material to the aforementioned drop port 52 through its movement in a direction toward the drop port 52 (in the longitudinal direction of the pusher 54). An ineffective region N is formed between adjacent ones of the effective regions E. When viewed from above, raw-material supplying pipes 59 for supplying the raw material M onto the hearth 51 and exhaust pipes 60 are connected to the furnace cover 55 in such a manner as to be located in the aforementioned effective regions E and in the ineffective regions N, respectively.

Next, in FIG. 5, cooling air is supplied from below into the deposited layer M2 inside the hollow cylindrical member 53 which forms the maturing section B. The raw material which constitutes this deposited layer M2 drops while maturing by means of the heat which it possesses, is gradually cooled by heat exchange with the cooling air, and is removed as a product from a discharge port (not shown) in a lower portion of the hollow cylindrical member 53. Meanwhile, the aforementioned cooling air rises through the aforementioned deposited layer M2 while being heated by the raw material, and flows into the aforementioned heating space 57 in the state of increased temperature, thereby contributing to the combustion of the heating gas.

In addition, the heating gas inside the heating space 57 enters the interior of the deposited layer of the raw material M on the hearth 51 from the deposited layer surface M1, and after heating the raw material M in the interior, the heating gas passes through the exhaust pipes 60, and is discharged to the outside as an exhaust gas.

With the above-described known apparatus and numerous other apparatuses similar thereto, the pushers are provided at a plurality of circumferential positions such that the rod-like pushers are capable of reciprocating in their longitudinal directions (i.e., in the radial direction of the hearth) and are arranged radially from a central portion of the hearth. When the pushers advance toward the opening formed in the central portion of the hearth, the pushers operate to push out the raw material to the opening, and this pushing out of the pushers acts effectively with respect to the raw material in regions each having a circumferentially fixed width. Namely, the effective regions having the aforementioned widths are present at a plurality of circumferential positions above the hearth, while the ineffective regions where the pushers exhibit no effect during their operation and the raw material does not move much are respectively formed between adjacent ones of the effective regions. These ineffective regions expand larger on the outer peripheral side as compared to the inner peripheral side of the hearth.

In the effective regions, the raw material moves effectively toward the drop port, and is replaced by new raw material which is consecutively supplied from the raw-material supplying pipes disposed in the effective regions. In contrast, since the exhaust pipes are located in the ineffective regions, the high-temperature gas from the heating space passes through the material in the ineffective regions and reaches the exhaust pipes, so as to heat the raw material in the ineffective regions which does not move much. Namely, in the effective regions, since the raw material moves despite the fact that the high-temperature gas does not actively flow into these regions, a large difference is produced in the degree of heating as compared with the raw material in the ineffective regions. That is, a difference is produced in the degree of heating depending on whether the raw material is located in the effective regions or the ineffective regions. In addition, since the high-temperature gas passes through the raw material in the ineffective regions which does not move much and is at the high temperature, the high-temperature gas is discharged from the exhaust pipes without having undergone sufficient heat exchange with the raw material, so that the thermal energy is not sufficiently utilized.

SUMMARY OF THE INVENTION

In view of the above-described circumstances, it is an object of the present invention to provide a raw-material heating apparatus which is capable of heating the raw material uniformly in the circumferential direction of the hearth and of improving the heating efficiency.

To attain the above object, in a raw-material heating apparatus in accordance with the present invention, a raw-material supplying pipe and an exhaust pipe are disposed in a peripheral portion of a furnace cover, and a heating space is formed by the furnace cover, a peripheral wall, and a hearth. A raw material which is supplied from the raw-material supplying pipe and deposited on the hearth is heated by a heating gas which flows into the heating space. In addition, a pusher for pushing out the raw material on the hearth toward a drop port formed in a central portion of the hearth is supported by the peripheral wall in such a manner as to be capable of reciprocating in a radial direction of the hearth. The raw material pushed out by the reciprocating motion of the pusher is caused to drop through the drop port.

In the present invention, the above-described raw-material heating apparatus is characterized in that lower-end openings of the raw-material supplying pipe and the exhaust pipe, when viewed in an axial direction of the apparatus, are disposed at a same position or at positions close to each other in an effective region for pushing out the raw material by the pusher.

In such a raw-material heating apparatus, the heating gas which is led from the heating space to the exhaust pipe after passing through the raw material on the hearth passes through the effective region where pushing out of the raw material by the pusher is effected actively, and is discharged from the exhaust pipe provided in close proximity to the raw-material supplying pipe in the effective region. Accordingly, the high-temperature heating gas is able to undergo sufficient heat exchange with the relatively low-temperature raw material which is consecutively pushed out. Hence, the heat efficiency improves, and the difference in the degree of heating does not become large as compared with an ineffective region.

In the present invention, the raw-material supplying pipe and the exhaust pipe may form a junction pipe at a position of their installation at the furnace cover. By adopting such an arrangement, the structure can be simplified. At that juncture, the junction pipe may be provided with a partition wall for partitioning its inner space into a space for the raw-material supplying pipe and a space for the exhaust pipe at at least a converging position. By virtue of the provision of the partition plate, the dust of the dropping raw material can be prevented from entering the exhaust pipe.

Preferably, the junction pipe should be open at a position above the pusher, i.e., at the same position as that of the pusher in the circumferential direction of the hearth. As a result, the effect of pushing out the raw material improves.

In addition, it is preferred that a plurality of pushers be provided as the pusher at a plurality of circumferential positions, and the raw-material supplying pipe and the exhaust pipe be disposed in the effective region for pushing out the raw material by each of the pushers. By adopting this arrangement, the pushing out and heating of the raw material are effected uniformly in the circumferential direction.

Further, there are many cases where a plurality of exhaust pipes are provided normally at a plurality of circumferential positions with respect to the furnace cover. In addition, since a heating apparatus-related device such as a burner is disposed on the axis at a position above the furnace cover, there are many cases where a collecting box with the exhaust pipes collected therein in one location is formed as an annular tubular member in which a hollow space for accommodating the heating apparatus-related device in the center is formed, and exhaust of gas is effected collectively by a single conduit pipe extending laterally from this collecting box. However, since this conduit pipe is singular, a biased suction force is produced in the collecting box, with the result that there are cases where the exhaust of gas from the plurality of exhaust pipes fails to become uniform.

Accordingly, in a preferred form of the present invention, a plurality of exhaust pipes are provided as the exhaust pipe at a plurality of circumferential positions, the plurality of exhaust pipes are connected to a first chamber of a collecting box, exhaust of gas is effected from a single conduit pipe connected to a second chamber of the collecting box communicating with the first chamber, and a combined area of openings of a plurality of communicating holes for causing the first chamber and the second chamber to communicate with each other is set to be smaller than a combined area of circulating sections of the plurality of exhaust pipes connected to the first chamber.

By adopting the above-described arrangement, even if the exhaust gas collected in the first chamber is brought into the second chamber and is exhausted from here by the single conduit pipe, since the pressure is distributed and is made uniform in the first chamber, the exhaust of gas from the plurality of exhaust pipes is made uniform.

The aforementioned collecting box may be formed as a hollow annular tubular member having an axis of the furnace cover as its center line, an inner space of the annular tubular member being partitioned into a first chamber and a second chamber by a partition wall having a plane substantially orthogonal to the axis and having the plurality of communicating holes formed therein, the plurality of exhaust pipes being connected to the first chamber in directions substantially parallel to the axis, and the single conduit pipe extending radially from the second chamber.

BRIEF DESCRIPTION OF THE DRAWINGS

FIGS. 4(A) and 4(B) are diagrams illustrating an apparatus concerning an exhaust system as another embodiment of the present invention, in which FIG. 4(A) is a horizontal cross-sectional view, and FIG. 4(B) is a cross-sectional view taken alone line B—B in FIG. 4(A);

DESCRIPTION OF THE PREFERRED EMBODIMENTS

Referring now to the accompanying drawings, a description will be given of an embodiment of the present invention.

Figure 1:
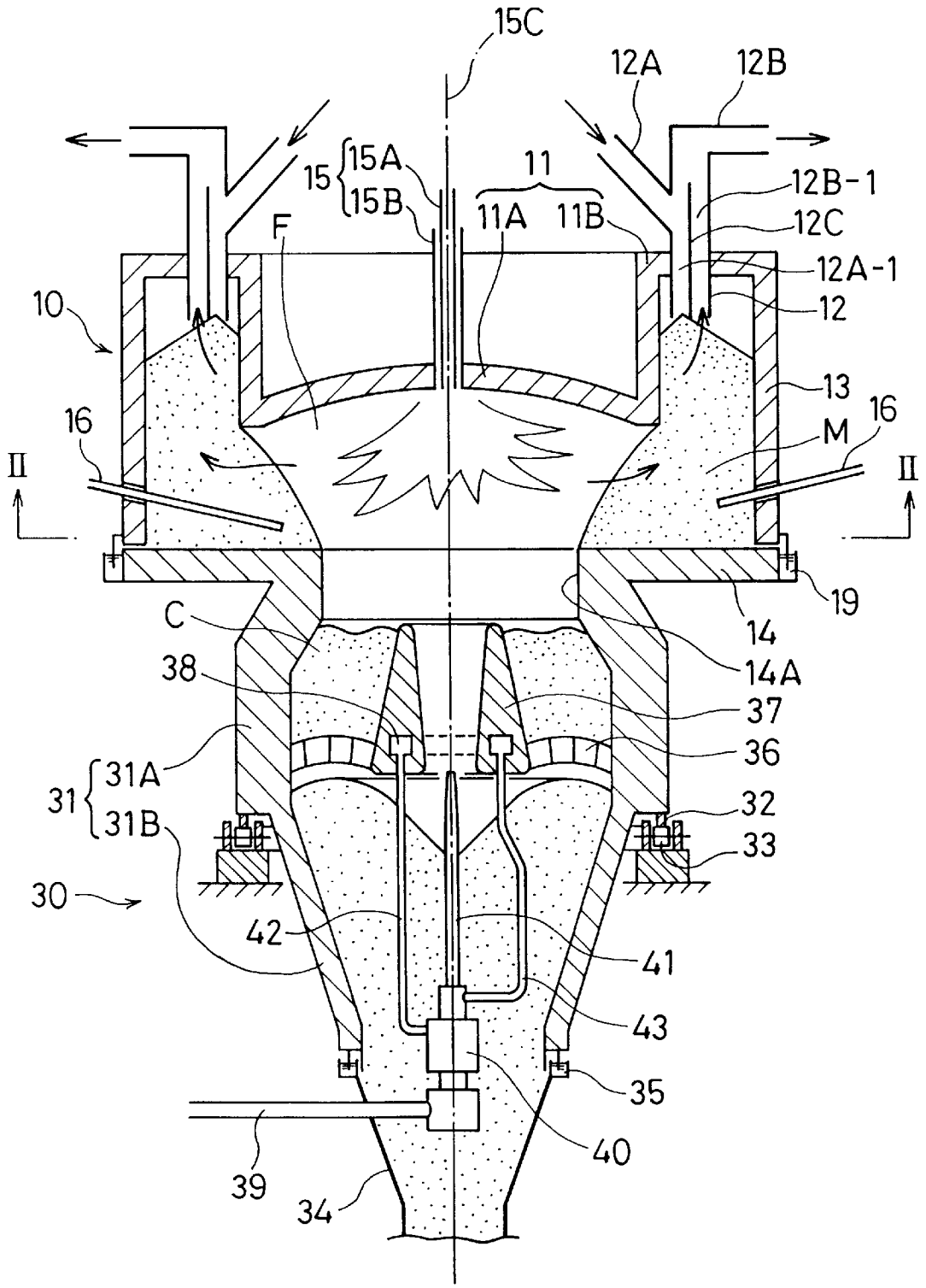
FIG. 1 is a vertical cross-sectional view of an embodiment of a raw-material heating apparatus in accordance with the present invention.
Figure 2:
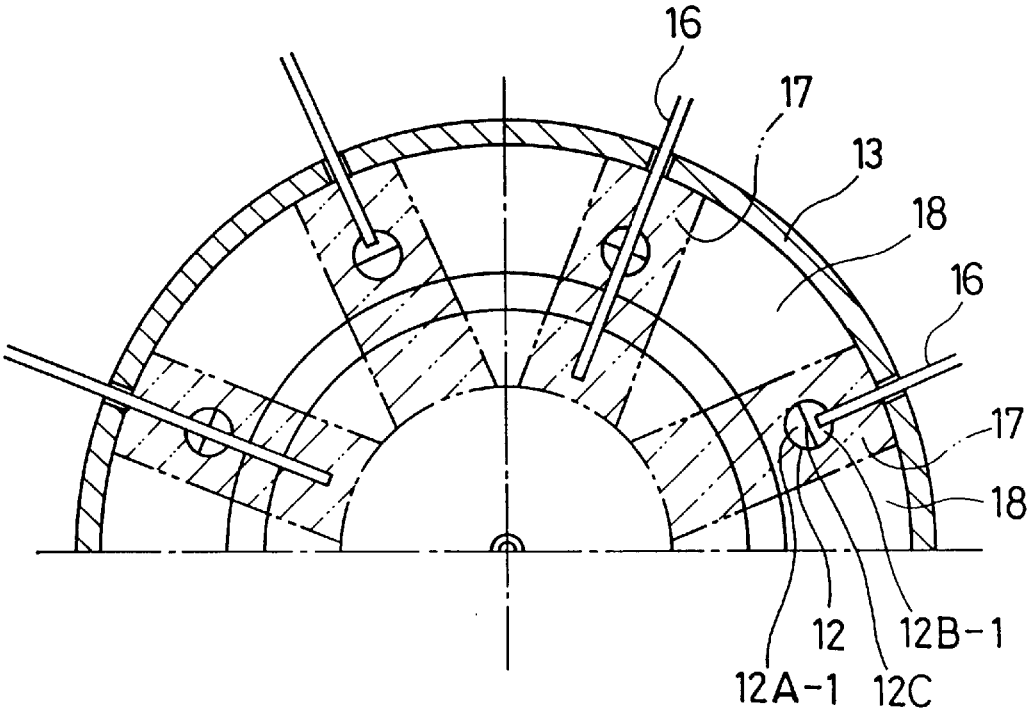
FIG. 2 is a cross-sectional view, taken along line II—II in FIG. 1, of the apparatus shown in FIG. 1.

FIG. 1 is a vertical cross-sectional view of the apparatus of this embodiment. FIG. 2 is a cross-sectional view taken along line II—II in FIG. 1. It should be noted that, in FIG. 2, a drop port located below the cross-sectional position in FIG. 1 is shown by a two-dot dash line.

In the embodiment shown in FIGS. 1 and 2, a raw-material heating apparatus 10 which is the apparatus of this embodiment is located above a secondary heating apparatus 30 for further heating the raw material to effect maturing and the like, and is operated by being connected to this secondary heating apparatus 30.

The heating apparatus 10 is comprised of a fixed furnace cover 11 whose central portion 11A is depressed downward and in which junction pipes 12 where raw-material supplying pipes 12A and exhaust pipes 12B converge are attached to its peripheral portion 11B; a hollow cylindrical peripheral wall 13 suspended from the periphery of the furnace cover 11; and a hearth 14 which rotates at a position which is in close proximity to a lower edge of the peripheral wall 13. The hearth 14 is formed integrally with an upper portion of the secondary heating apparatus 30 which will be described later. It should be noted that each of the aforementioned furnace cover 11, peripheral wall 13, and hearth 14 is formed of a heat insulating material.

A heating-gas blowing pipe 15 is connected to the central portion 11A of the furnace cover 11 at the position of a vertical axis 15C of the furnace. The heating-gas blowing pipe 15 has a fuel supplying pipe 15A and a combustion-air supplying pipe 15B, and a combustion gas is adapted to be ejected downward toward a heating space F as a heating gas. In a preferable form, the plurality of raw-material supplying pipes 12A and exhaust pipes 12B provided in the peripheral portion 11B of the furnace cover 11 are located at equal intervals in the circumferential direction. The positions and arrangement of these raw-material supplying pipes will be described later in connection with the pushers.

A drop port 14A is formed in the hearth 14 with the aforementioned vertical axis 15C as its center, and the raw material supplied from the raw-material supplying pipes 12A forms a deposited layer M on the upper surface of the hearth 14. As also shown in FIG. 2 in which the deposited layer M is not shown, rod-like pushers 16 are provided at positions immediately above the hearth 14 in such a manner as to penetrate the peripheral wall at a plurality of circumferential positions and to be capable of reciprocating in their longitudinal directions. The pushers 16 extend radially, and are driven by driving devices (not shown) located outside the furnace, so as to reciprocate in their longitudinal directions. One pusher 16 may be formed by a single rod or by a combination of a plurality of rods.

When the pushers 16 are driven forward toward the vertical axis 15C of the furnace, the pushers 16 produce the effect of pushing out the raw material, which forms the deposited layer M on the hearth 14, toward the drop port 14A, and this effect is effective in regions each having a fixed width in the circumferential direction with respect to each pusher 16, and forms effective regions 17. This means that ineffective regions 18 where the pushers 16 do not act effectively are each formed between one effective region 17 and another effective region 17 adjacent thereto.

Next, the arrangement and positions of the aforementioned raw-material supplying pipes 12A and exhaust pipes 12B will be described in connection with the pushers 16. Outside the apparatus, the raw-material supplying pipes 12A and the exhaust pipes 12B form separate systems and are respectively connected to a raw-material storage tank and a suction device (neither are shown). At a position where they are connected to the furnace cover 11, the raw-material supplying pipes 12A and the exhaust pipes 12B are combined as units and form the junction pipes 12. In a preferable form, each of the junction pipes 12 is partitioned such that its inner space forms two mutually semicircular spaces 12A-1 and 12B-1 in its horizontal section by means of a partition plate 12C. One space 12A-1 partitioned by the partition plate 12C communicates with the raw-material supplying pipe 12A, while the other space 12B-1 communicates with the exhaust pipe 12B. Further, the two spaces communicate with each other at upper and lower ends of the partition plate 12C.

Such a junction pipe 12 is located in the effective region 16. Preferably, the junction pipe 12 is located above (immediately above) the pusher 16.

As shown in FIG. 1, the secondary heating apparatus 30 is formed below the hearth 14, and the hearth 14 is disposed in close proximity to a peripheral edge of a lower end of the peripheral wall 13 and is rotatable relative to the peripheral wall 13 while maintaining a sealed state by means of a sealing device 19 such as a water seal. This hearth 14 is formed integrally with an upper end of a hollow cylindrical vertical-type furnace body 31 at its inside-diameter portion which forms the aforementioned drop port 14A. The vertical-type furnace body 31 has a stepped portion at an intermediate portion of its outer surface. An annular rail 32 is provided on a lower surface of this stepped portion, and the vertical-type furnace body 31 is adapted to rotate very slowly by receiving rotative drive on a plurality of rollers 33 disposed in an annular arrangement on a floor surface. As a result of this rotation, the hearth 14 is also rotated.

As shown in FIG. 1, the vertical-type furnace body 31 of the secondary heating apparatus 30 has an upper hollow cylindrical section 31A and a lower conical section 31B, and the aforementioned annular rail 32 is disposed in between these sections. A fixed discharge section 34 is provided immediately below the conical section 31B, and the vertical-type furnace body 31 is rotatable with respect to the discharge section 34 via a sealing device 35 such as a water seal.

A tubular diffuser 37, which is supported by arches 36 extending radially inwardly from an inner wall surface of the hollow cylindrical section 31A at a plurality of circumferential positions, is provided inside the hollow cylindrical section 31A. An air jacket 38 for cooling is provided inside the diffuser 37. An air supplying pipe 39 extends into and is disposed inside the conical section 31B, and is connected via a rotary joint 40 to an ejector 41 which is open at its upper end in the form of a nozzle. A conduit pipe 42 branches off the rotary joint 40, is connected to the air jacket 38 so as to supply air to the air jacket 38, and leads to a proximal portion of the ejector 41 through a conduit pipe 43.

It should be noted that, in the present invention, a plurality of pushers may be provided at different positions in the heightwise direction of the heating apparatus in one effective region, or the pushers may be located at heightwise different positions in different effective regions.

In the above-described apparatus of this embodiment, the raw material is heated as follows.

① The raw material to be heated is charged and supplied from the raw-material supplying pipes 12A, passes through the spaces 12A-1 of the junction pipes 12, and is allowed to drop onto the hearth 14, thereby forming the deposited layer M. The raw material in the deposited layer M is directly heated by the heating gas at its portion facing the heating space F. Inside the deposited layer M, the raw material is also subjected to heating by the heating gas which enters the deposited layer M from the heating space F and passes to the exhaust pipes 12B through the spaces 12B-1 in the junction pipes 12. Namely, the heating gas passes through the spaces 12B-1 in the junction pipes 12 located in the effective regions 17 and is discharged from the exhaust pipes 12. The heating gas during its flow effectively heats the raw material in the effective regions 17, while its own temperature is lowered.

② Above the hearth 14, the pushers 16 located immediately below the raw-material supplying pipes 12 reciprocate at appropriate timings. The raw material over the effective region 17 is thereby pushed out consecutively toward the drop port 14A and is allowed to drop from the drop port 14A, thereby forming a deposited layer C again inside the vertical-type furnace body 31 of the secondary heating apparatus 30. Thus, the raw material over the effective regions 17 is actively heated, and the heating of the new raw material pushed out toward the drop port 14A is consecutively effected.

③ The raw material in the deposited layer M on the hearth 14 is allowed to drop into the vertical-type furnace body 31 while moving in the circumferential direction in conjunction with the rotation of the hearth 14 through the action of the pushers 16. Accordingly, the dropping rate becomes uniform in the circumferential direction as well. This means that the heating of the raw material over the rotary hearth 14 is effected further uniformly in the circumferential direction. It should be noted that the rotary hearth 14 rotates very slowly.

④ The heated and unmatured raw material which was dropped from the hearth 14 is formed in the inner space of the vertical-type furnace body 31 as the deposited layer C. At that juncture, the deposited layer has a lower surface which is formed on the radially inward side or the lower side of the diffuser 37 and an upper surface which is formed on the radially outer side of the diffuser 37 by virtue of the presence of the diffuser 37.

⑤ In the lower portion of such a furnace body 31, the air for driving the ejector enters the conduit pipe 42 from the air supplying pipe 39 via the rotary joint 40, and flows into the annular air jacket 38 for cooling the ejector. After cooling the jacket 38, the air for driving the ejector passes through the conduit pipe 43 and is ejected upward from the nozzle of the ejector 41 at a high flow rate. The pressure in the spa ce facing the lower surface of the deposited layer C is lowered due to the action of the high-flow-rate ejection at that time and the diffuser 37, which in turn causes the high-temperature heating gas on the upper surface of the deposited layer C to pass through the upper surface and flows downward through the deposited layer C, thereby heating the raw material by means of convection heat transfer.

⑥ Since the pressure in the space facing the low er surface of the deposited layer C is lowered, the cooling air which is supplied from an arbitrary position in the discharge section 34 is sucked upward and flows upward, and undergoes heat exchange with the raw material subjected to secondary heating, thereby cooling the raw material while the cooling air itself is heated. Then, after the cooling air flows out from the lower surface of the deposited layer C, the cooling air rises toward the lower space in the heating space F while being mixed with the heating gas and the air for driving the ejector, which flowed downward through the deposited layer C and reached the lower surface and which were described in ⑤ above, thereby contributing to the combustion in the heating space F.

⑦ The raw material for which secondary heating was completed is cooled at the bottom portion of the deposited layer C, and the raw material which is set to a sufficiently low temperature is discharged from the discharge section 34 as a product. A discharging mechanism used at that time may be arbitrary.

Figure 3:
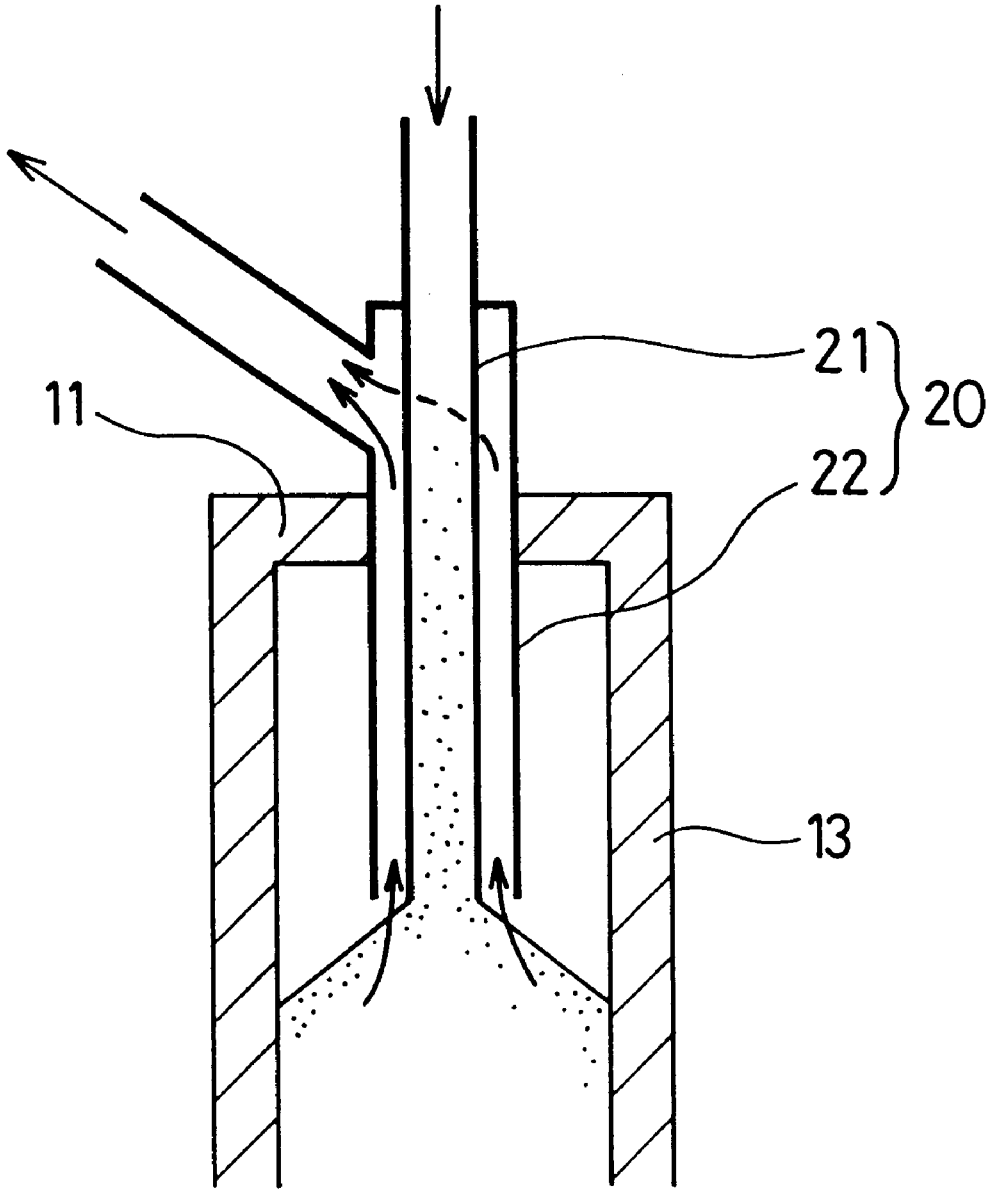
FIG. 3 is a diagram illustrating a modification of a junction pipe of the apparatus shown in FIG. 1.

Although, in this embodiment, the inner space of the junction pipe 12 is formed into the two semicircular spaces 12A-1 and 12B-1 in its horizontal section by means of the partition plate 12C, an arrangement may be provided such that, as shown in FIG. 3, a concentric pipe assembly 20 is provided, and its inner pipe 21 is connected to the raw-material supplying pipe, and its outer pipe 22 is connected to the exhaust pipe.

In the case of the raw-material heating apparatus of this type, the raw-material heating apparatus is relatively large in its diameter, and there are many cases where a plurality of exhaust pipes are provided normally at a plurality of circumferential positions with respect to the furnace cover. In addition, since a heating apparatus-related device such as a burner is disposed on the axis at a position above the furnace cover, there are many cases where a collecting box with the exhaust pipes collected therein in one location is formed as an annular tubular member in which a hollow space for accommodating the heating apparatus-related device in the center is formed, and exhaust of gas is effected collectively by a single conduit pipe extending laterally from this collecting box. However, since this conduit pipe is singular, a biased suction force is produced in the collecting box, with the result that there are cases where the exhaust of gas from the plurality of exhaust pipes fails to become uniform.

Accordingly, in a preferred form of the present invention, an arrangement is provided such that the plurality of exhaust pipes are provided at a plurality of circumferential positions, the plurality of exhaust pipes are connected to a first chamber of a collecting box, exhaust of gas is effected from a single conduit pipe connected to a second chamber of the collecting box communicating with the first chamber, and the combined area of openings of a plurality of communicating holes for causing the first chamber and the second chamber to communicate with each other is set to be smaller than the combined area of circulating sections of the plurality of exhaust pipes connected to the first chamber.

Figure 4A:
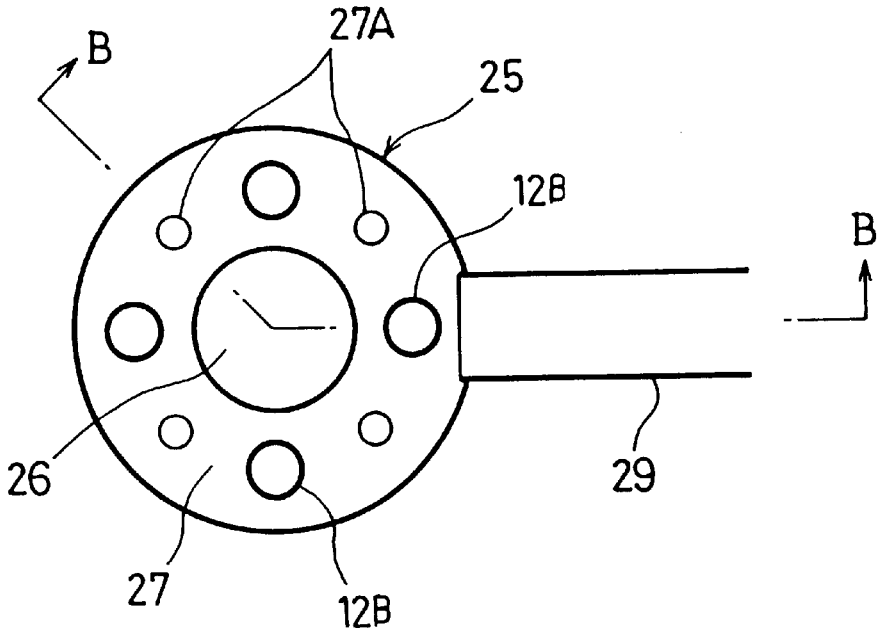
Figure 4B:
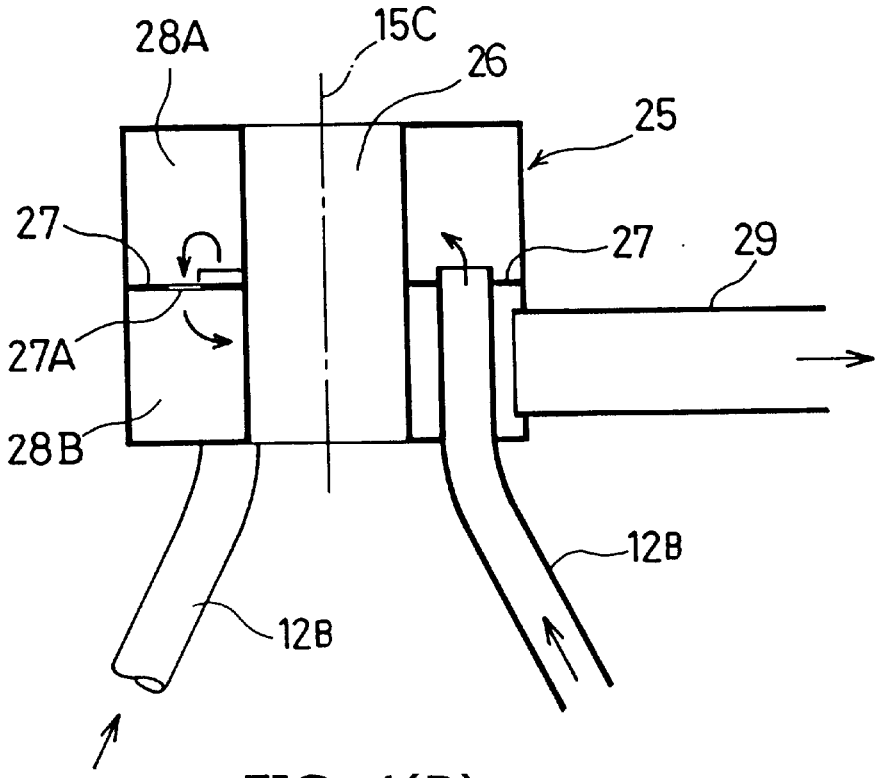
Figure 5:
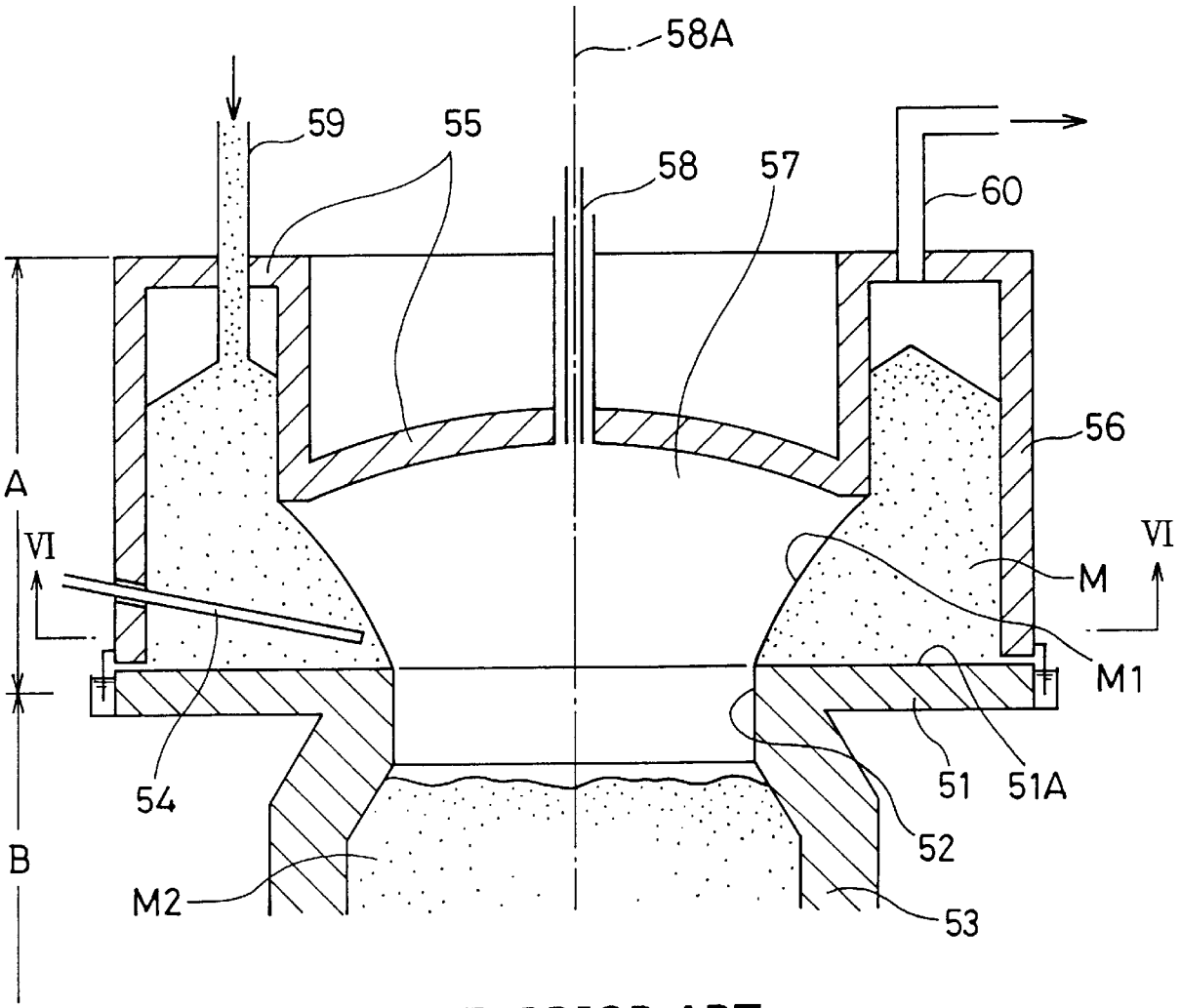
FIG. 5 PRIOR ART
FIG. 5 is a vertical cross-sectional view of a conventional apparatus.
Figure 6:
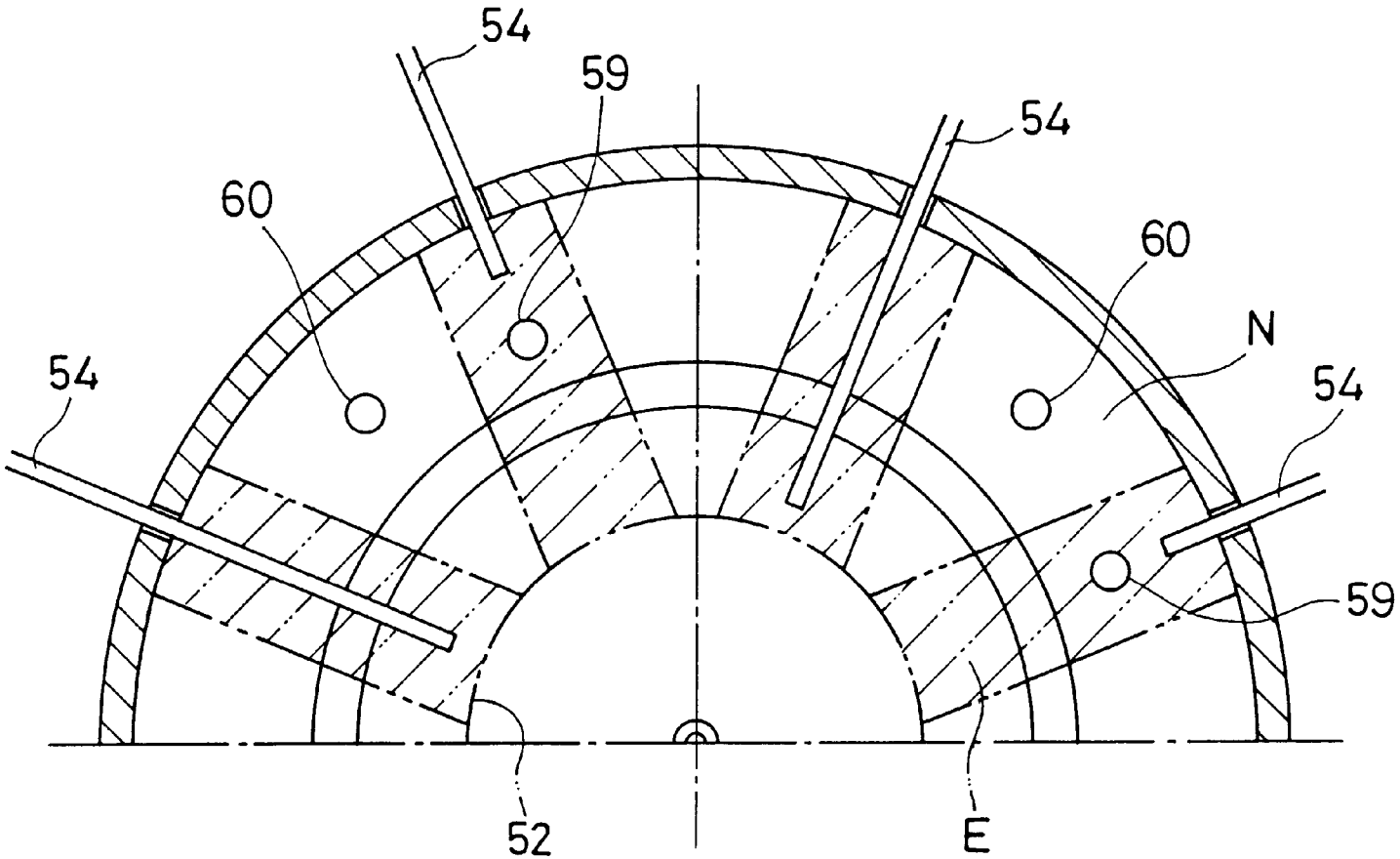
FIG. 6 PRIOR ART
FIG. 6 is a cross-sectional view, taken along line VI—VI in FIG. 1, of the apparatus shown in FIG. 5.

For example, the aforementioned collecting box may be arranged as shown in FIGS. 4(A) and 4(B), in which the collecting box is formed as an annular tubular member having a hollow space 26 for accommodating the heating apparatus-related device (not shown) and having the axis 15C of the furnace cover as a center line, and an inner space of the annular tubular member is partitioned into a first chamber 28A and a second chamber 28B by a partition wall 27 having a plane substantially orthogonal to the axis and having a plurality of communicating holes 27A formed therein, the plurality of exhaust pipes 12B being connected to the first chamber 28A in directions substantially parallel to the axis 15C, and a single conduit pipe 29 extending radially from the second chamber 28B. The combined area of openings of the plurality of communicating holes 27A is set to be smaller than the combined circulating sectional areas of the plurality of exhaust pipes 12B.

By adopting the above-described arrangement, even if the exhaust gas collected in the first chamber 28A is brought into the second chamber 28B and is exhausted from here by the single conduit pipe 29, since the first chamber 28A serves as a buffer, and the pressure is distributed and is made uniform in the first chamber 28A, the exhaust of gas from the plurality of exhaust pipes 12B is made uniform.

The apparatus of the present invention can be also connected to a secondary heating apparatus other than the type shown in FIG. 1. For example, it is possible to adopt a horizontal-type rotary kiln (not shown) as the secondary heating apparatus. At that juncture, the rotary hearth 14 and the rotary kiln are connected by a connecting cylinder which guides the raw material while permitting the relative rotation of the two members.

In addition, in the present invention, it is not necessarily essential to provide the heating-gas blowing pipe such as the one shown in FIG. 1 for blowing the combustion gas into the heating space. For example, an arrangement may be provided such that the heating gas from the secondary heating apparatus connected to the heating apparatus of the present invention is led to the aforementioned heating space.

As described above, in accordance with the present invention, since lower-end openings of the raw-material supplying pipes and the exhaust pipes, when viewed in the axial direction, are disposed at the same positions or at positions close to each other in the effective regions for pushing out the raw material by the pushers, the pushing out of the raw material toward the drop port is effected actively in the effective regions, and the heating gas circulates through the raw material toward the openings of the exhaust pipes. Therefore, the raw material in the effective regions is heated effectively. In consequence, the efficiency in heat exchange between the heating gas and the raw material improves. In addition, unevenness in heating between the effective region and the ineffective region is reduced, contributing to the uniformalization of the product.

What is claimed is:

1. A raw-material heating apparatus comprising:

a furnace cover;

a peripheral wall suspended from a periphery of said furnace cover;

a hearth adapted to rotate at a position which is in close proximity to a lower edge of said peripheral wall, a heating space being formed by said furnace cover, said peripheral wall, and said hearth;

a raw-material supplying pipe disposed in a peripheral portion of said furnace cover so as to supply a raw material onto said hearth, the raw material which is supplied from said raw-material supplying pipe and deposited on said hearth being heated by a heating gas which flows into said heating space;

an exhaust pipe disposed in the peripheral portion of said furnace cover; and a pusher supported by said peripheral wall in such a manner as to be capable of reciprocating in a radial direction of said hearth so as to push out the raw material on said hearth toward a drop port formed in a central portion of said hearth, the deposited raw material on said hearth being caused to drop consecutively through said drop port by the reciprocating motion of said pusher, wherein lower-end openings of said raw-material supplying pipe and said exhaust pipe, when viewed in an axial direction of said apparatus, are disposed at a same position or at positions close to each other in an effective region for pushing out the raw material by said pusher.

2. The raw-material heating apparatus according to claim 1, wherein said raw-material supplying pipe and said exhaust pipe form a junction pipe at a position of their installation at said furnace cover.

3. The raw-material heating apparatus according to claim 2, wherein said junction pipe is provided with a partition wall for partitioning its inner space into a space for said raw-material supplying pipe and a space for said exhaust pipe at at least a converging position.

4. The raw-material heating apparatus according to claim 2 or 3, wherein said junction pipe is open at a position above said pusher.

5. The raw-material heating apparatus according to claim 1, wherein a plurality of pushers are provided as said pusher at a plurality of circumferential positions, and said raw-material supplying pipe and said exhaust pipe are disposed in said effective region for pushing out the raw material by each of said pushers.

6. The raw-material heating apparatus according to claim 1, wherein a plurality of exhaust pipes are provided as said exhaust pipe at a plurality of circumferential positions, said plurality of exhaust pipes are connected to a first chamber of a collecting box, exhaust of gas is effected from a single conduit pipe connected to a second chamber of said collecting box communicating with said first chamber, and a combined area of openings of a plurality of communicating holes for causing said first chamber aid said second chamber to communicate with each other is set to be smaller than a combined area of circulating sections of said plurality of exhaust pipes connected to said first chamber.

7. The raw-material heating apparatus according to claim 6, further comprising:

a collecting box formed as a hollow annular tubular member having an axis of said furnace cover as its center line, an inner space of said annular tubular member being partitioned into a first chamber and a second chamber by a partition wall having a plane substantially orthogonal to the axis and having the plurality of communicating holes formed therein, said plurality of exhaust pipes being connected to said first chamber in directions substantially parallel to the axis, and said single conduit pipe extending radially from said second chamber.

* * * * *